US009075391B2

(12) United States Patent
Ono

(10) Patent No.: US 9,075,391 B2
(45) Date of Patent: Jul. 7, 2015

(54) IMAGE FORMING APPARATUS

(71) Applicant: Kyocera Document Solutions Inc., Osaka (JP)

(72) Inventor: Tomohisa Ono, Osaka (JP)

(73) Assignee: KYOCERA Document Solutions Inc., Osaka (JP)

( * ) Notice: Subject to any disclaimer, the term of this patent is extended or adjusted under 35 U.S.C. 154(b) by 0 days.

(21) Appl. No.: 14/259,533

(22) Filed: Apr. 23, 2014

(65) Prior Publication Data

US 2014/0321877 A1 Oct. 30, 2014

(30) Foreign Application Priority Data

Apr. 25, 2013 (JP) ..... 2013-092656

(51) Int. Cl.
*G03G 21/20* (2006.01)

(52) U.S. Cl.
CPC ..... *G03G 21/206* (2013.01); *G03G 2221/1645* (2013.01); *G03G 2215/00421* (2013.01); *G03G 2215/00417* (2013.01); *G03G 2215/00742* (2013.01)

(58) Field of Classification Search
CPC ..... G03G 21/206; G03G 2221/1645; G03G 2215/00742; G03G 2215/00417; G03G 2215/00421
USPC ..... 399/92
See application file for complete search history.

(56) References Cited

U.S. PATENT DOCUMENTS

2006/0093420 A1* 5/2006 Oba ..... 399/405
2010/0254721 A1* 10/2010 Fukita et al. ..... 399/44
2013/0051835 A1* 2/2013 Kubo ..... 399/92

FOREIGN PATENT DOCUMENTS

JP 2000-003083 A 1/2000

* cited by examiner

*Primary Examiner* — David Gray
*Assistant Examiner* — Tyler Hardman
(74) *Attorney, Agent, or Firm* — Studebaker & Brackett PC

(57) ABSTRACT

An image forming apparatus includes an ejection stacking section, a cooling target unit, and a cooling fan. The cooling target unit is disposed below the ejection stacking section. The cooling fan sends air to flow between the cooling target unit and the ejection stacking section. The ejection stacking section includes an opening, a movable member, and a biasing member. The movable member is movable between a closed position and an open position. The biasing member biases the movable member toward the closed position. In response to that the recording mediums are stacked on the ejection stacking section, the movable member moves toward the open position against a biasing force of the biasing member to allow the air sent from the cooling fan to flow through the opening so as to cool a lower surface of the recording mediums stacked on the ejection stacking section.

14 Claims, 6 Drawing Sheets

IMAGE FORMING APPARATUS

INCORPORATION BY REFERENCE

The present application claims priority under 35 U.S.C. §119 to Japanese Patent Application No. 2013-092656, filed Apr. 25, 2013. The contents of this application are incorporated herein by reference in their entirety.

BACKGROUND

The present disclosure relates to image forming apparatuses and in particular to a cooling mechanism of an image forming apparatus.

In one example, an electrographic image forming apparatus causes toner to adhere to an electrostatic latent image formed on an image bearing member. As a result, a visible image (toner image) is formed on the image bearing member. Subsequently, the toner image is transferred to a recording medium, and then heat and pressure is applied to the recording medium by the fixing section to fix the toner image to the recording medium.

The image forming apparatus described above includes a toner container for supplying toner to a developing unit. The toner container is detachably disposed at an upper part of the main body. In addition, the image forming apparatus described above includes a section on which recording mediums each ejected after an image is formed thereon are stacked (the section is hereinafter referred to as an "ejection stacking section"). The ejection stacking section is disposed on the upper surface of the main body. With respect to such an image forming apparatus, the ejection stacking section and the toner container are only a short distance away from each other. As a consequence, heat applied to a recording medium by the fixing section is conducted to the toner container via the ejection stacking section, which often raises the temperature of the toner container high. When the temperature of the toner container is raised high, the toner stored in the toner container tends to degrade.

SUMMARY

An image forming apparatus according to the present disclosure includes an ejection stacking section, a cooling target unit, and a cooling fan. One or more recording mediums each having an image formed thereon are stacked on the ejection stacking section. The cooling target unit is disposed below the ejection stacking section. The cooling fan sends air to flow between the cooling target unit and the ejection stacking section. The ejection stacking section includes an opening, a movable member, and a biasing member. The movable member is movable between a closed position at which the movable member closes the opening and an open position at which the movable member opens the opening. The open position is below the closed position. The biasing member biases the movable member toward the closed position. In response to that the recording mediums are stacked on the ejection stacking section, the movable member moves toward the open position against a biasing force of the biasing member to allow the air sent from the cooling fan to flow through the opening so as to cool a lower surface of the recording mediums stacked on the ejection stacking section.

DETAILED DESCRIPTION

Figure 1:
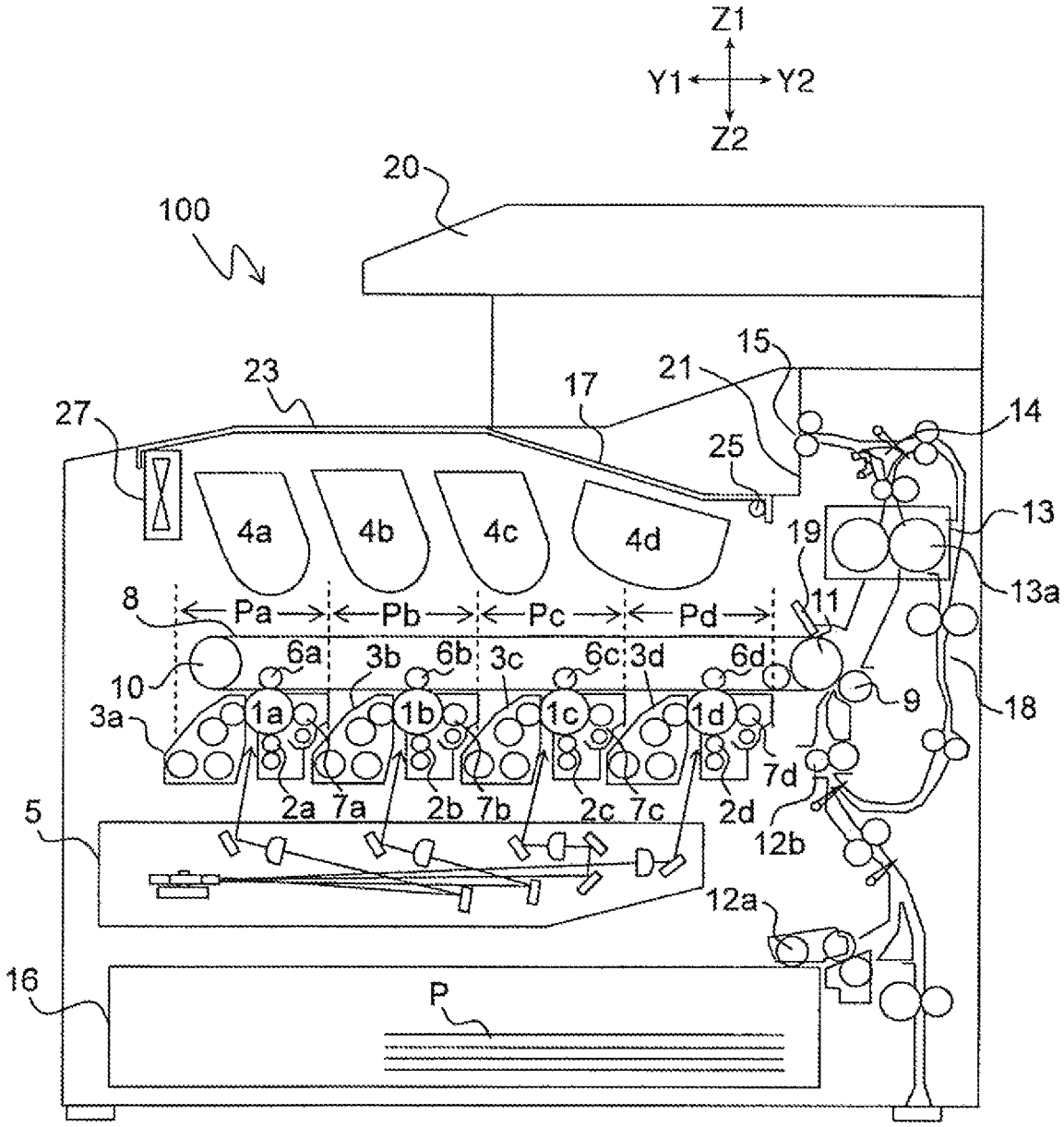
FIG. 1 is a cross sectional view showing an internal structure of an image forming apparatus according to an embodiment of the present disclosure.
Figure 5:
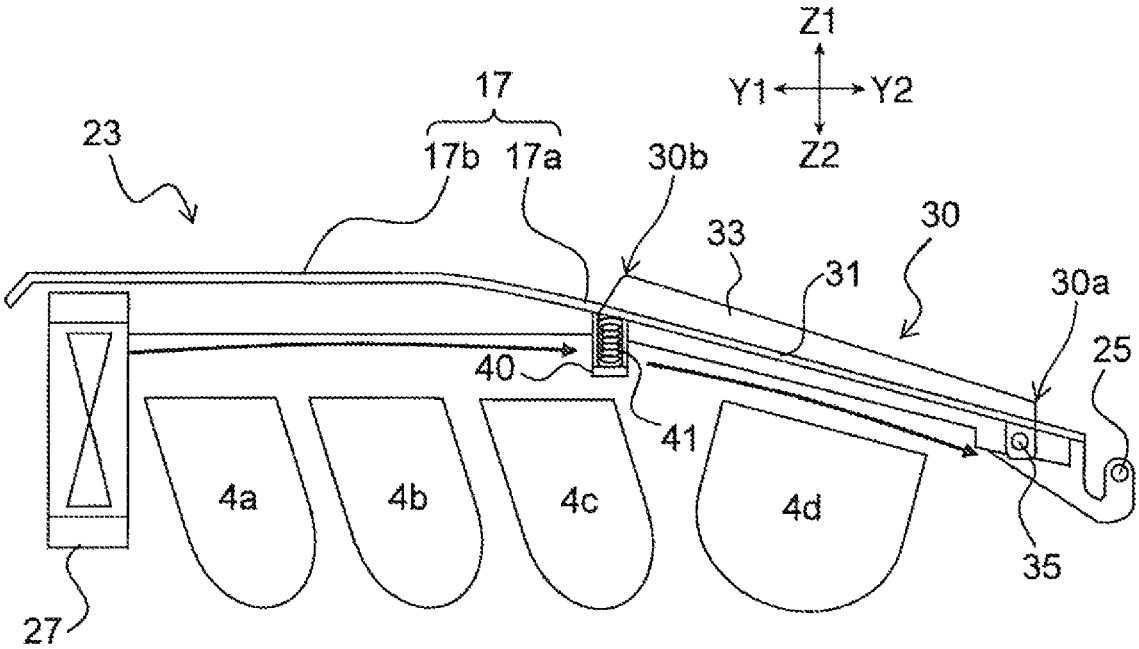
FIG. 5 is a cross sectional view of a passageway of air from a cooling fan when the number of sheets of transfer paper stacked on an ejection stacking section of the image forming apparatus according to the embodiment of the present disclosure is less than a predetermined number.
Figure 6:
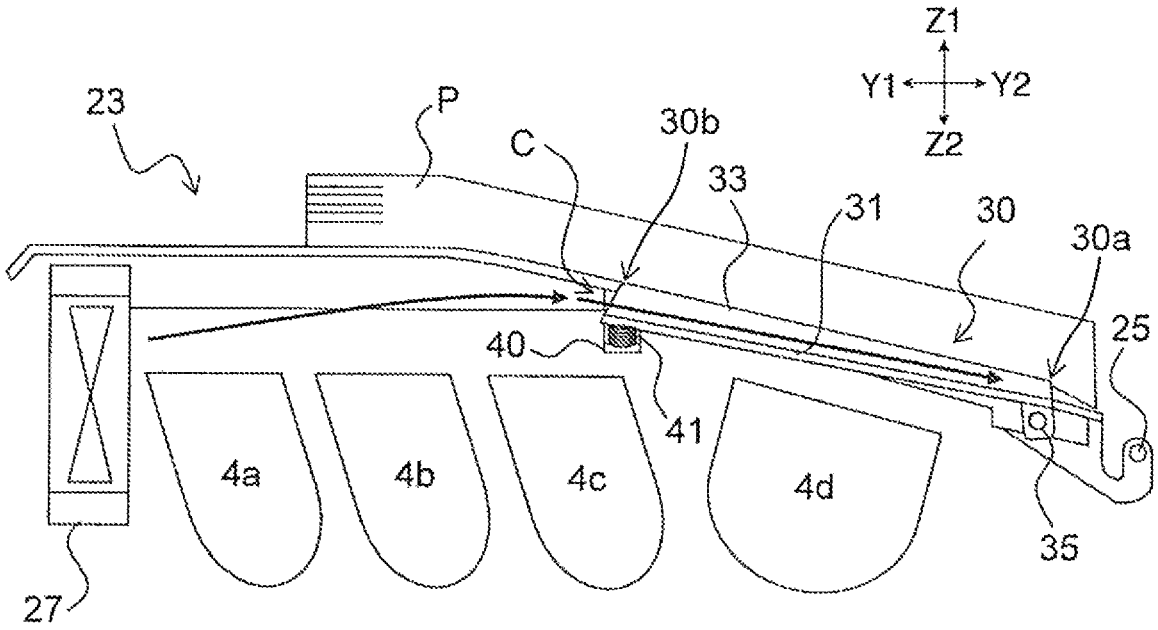
FIG. 6 is a cross sectional view of a passageway of air from the cooling fan when the number of sheets of transfer paper stacked on the ejection stacking section of the image forming apparatus according to the embodiment of the present disclosure is equal to the predetermined number or more.

The following describes an embodiment of the present disclosure, with reference to the accompanying drawings. First, with reference to FIG. 1, the following describes a schematic structure of an image forming apparatus 100 according to the present embodiment. In FIGS. 1, 5, and 6, arrows Y1, Y2, Z1, and Z2 indicate four directions along Y and Z axes, out of three axes (X, Y, and Z axes) that intersect with one another. The direction toward Z1 corresponds to "up", Z2 to "down", Y1 to "front", and Y2 to "rear".

As shown in FIG. 1, the image forming apparatus 100 according to the present embodiment is a tandem-type color multifunction peripheral. The image forming apparatus 100 includes a main body and an image reading section 20. The main body of the image forming apparatus 100 includes a cassette 16, a paper feed roller 12*a*, a registration roller pair 12*b*, four image forming sections Pa, Pb, Pc, and Pd, four toner containers (toner reservoirs) 4*a*, 4*b*, 4*c*, and 4*d*, an intermediate transfer belt 8, a nip part (secondary transfer nip part), a fixing section 13, a branch section 14, an ejection roller pair 15, and a cooling fan 27.

The cassette 16 is disposed at a lower part of the image forming apparatus 100. The cassette 16 is loaded with recording mediums (for example, transfer paper P). The toner containers 4*a*, 4*b*, 4*c*, and 4*d* store toners of mutually different colors (for example, cyan, magenta, yellow, and black). The intermediate transfer belt 8 is wound around a conveyance roller 10 (at an upstream side in a conveyance direction) and a drive roller 11 (at a downward side in the conveyance direction). The nip part is formed between the drive roller 11 of the intermediate transfer belt 8 and a secondary transfer roller 9 that is disposed adjacent to the drive roller 11. A belt cleaner 19 having a blade-like shape is disposed downstream from the secondary transfer roller 9 in the conveyance direction, for cleaning toner or the like remaining on the surface of the intermediate transfer belt 8. The fixing section 13 includes a fixing roller pair 13*a*. The fixing section 13 is located at an upper part of the main body of the image forming apparatus 100. In addition, an ejection stacking section 17 is formed in the upper surface of the main body. The toner containers 4*a*, 4*b*, 4*c*, and 4*d* are disposed at the upper part of the main body of the image forming apparatus 100 and independently detachable. The toner containers 4*a*, 4*b*, 4*c*, and 4*d* are all located directly below (toward Z2) the ejection stacking section 17.

The image forming sections Pa, Pb, Pc, and Pd are disposed in the stated order from the upstream side in the conveyance direction (from the left in FIG. 1). The image forming sections Pa-Pd form images with the toners of mutually different colors (for example, cyan, magenta, yellow, and black). Through the charging process, exposing process, developing process, and transfer process, the images of the respective colors of cyan, magenta, yellow, and black are sequentially formed on the transfer paper P.

The image forming sections Pa, Pb, Pc, and Pd have rotatable photosensitive drums 1*a*, 1*b*, 1*c*, and 1*d*, respectively. The photosensitive drums 1*a*, 1*b*, 1*c*, and 1*d* each bear a visible image (toner image) of a corresponding color. The respective photosensitive drums 1*a*, 1*b*, 1*c*, and 1*d* are surrounded by chargers 2*a*, 2*b*, 2*c*, and 2*d*, developing units 3*a*, 3*b*, 3*c*, and 3*d*, primary transfer rollers 6*a*, 6*b*, 6*c*, and 6*d*, and cleaning sections 7*a*, 7*b*, 7*c*, and 7*d*. In addition, a laser scanning unit (LSU) 5 is disposed below the photosensitive drums 1*a*, 1*b*, 1*c*, and 1*d*. In the following description, the image forming sections Pa, Pb, Pc, and Pd may each be referred to as an image forming section Px when it is not necessary to distinguish the respective image forming sections from one another (when the common characteristics thereof are described). Likewise, the photosensitive drums 1*a*, 1*b*, 1*c*, and 1*d* may each be referred to as a photosensitive drum 1*x*, the chargers 2*a*, 2*b*, 2*c*, and 2*d* may each be referred to as a charger 2*x*, the developing units 3*a*, 3*b*, 3*c*, and 3*d* may each be referred to as a developing unit 3*x*, the toner containers 4*a*, 4*b*, 4*c*, and 4*d* may each be referred to as a toner container 4*x*, the primary transfer rollers 6*a*, 6*b*, 6*c*, and 6*d* may each be referred to as a primary transfer roller 6*x*, and the cleaning sections 7*a*, 7*b*, 7*c*, and 7*d* may each be referred to as a cleaning section 7*x*.

The charger 2*x* charges the photosensitive drum 1*x*. The laser scanning unit 5 exposes the photosensitive drum 1*x* to light according to image data. The developing unit 3*x* forms a toner image on the photosensitive drum 1*x*. The developing units 3*a*, 3*b*, 3*c*, and 3*d* are each filled with a predetermined amount of a two-component developer containing the toner of the corresponding color (for example, cyan, magenta, yellow, or black). Each toner container 4*x* supplies the toner of a corresponding color. The cleaning section 7*x* removes the developer (toner) or the like remaining on the photosensitive drum 1*x*.

The intermediate transfer belt 8 is a belt without a joint (seamless belt), for example. The intermediate transfer belt 8 is made from dielectric resin, for example. The intermediate transfer belt 8 is adjacent to each of the image forming sections Pa-Pd. The intermediate transfer belt 8 is driven to rotate counterclockwise in FIG. 1, by a drive section (not shown). The intermediate transfer belt 8 rotates while staying in contact with the respective photosensitive drums 1*x*.

The image reading section 20 includes a scanning optical system, a condensing lens, and a CCD sensor (all of which are not shown). The scanning optical system includes a scanner lamp that illuminates an original document in copying operation and a mirror for changing the optical path of light reflected from the original document. The condensing lens concentrates light reflected from the original document to form an image. The CCD sensor converts the image forming light into an electric signal. The image reading section 20 reads the image of the original document and converts the read image into image data.

Next, with reference to FIG. 1, a description is given of the operation of the image forming apparatus 100, especially of the operation related to image formation.

First, the image reading section 20 obtains image data. Next, the charger 2*x* uniformly charges the surface of the photosensitive drum 1*x*. Then, the laser scanning unit 5 exposes the photosensitive drum 1*x* to light according to the image data. As a result, an electrostatic latent image conforming to the image data is formed on the photosensitive drum 1*x*. Note that the process of forming an electrostatic latent image on the photosensitive drum 1*x* is performed with the photosensitive drum 1*x* rotating clockwise in FIG. 1.

Subsequently, the developing unit 3*x* supplies the toner to the photosensitive drum 1*x*. The supplied toner adheres selectively to exposed regions (or unexposed regions) of the surface of the photosensitive drum 1*x*. As a result, a toner image conforming to the electrostatic latent image is formed on the photosensitive drum 1*x*. When the toner content in the two-component developer filled in the developing unit 3*x* falls below a prescribed percentage as the toner is used for toner image formation, the developing unit 3*x* is replenished with toner supplied from the toner container 4*x*.

Subsequently, a power supply unit not shown in the figures applies a predetermined transfer voltage to the primary transfer roller 6*x*. As a result, the toner images on the respective photosensitive drums 1*x* (the toner images of the four colors of yellow, cyan magenta, and black) are transferred to the intermediate transfer belt 8 in the primary transfer process. The images of the four colors (toner images) are formed to have a positional relation determined in advance for forming a full color image altogether. Thereafter, the cleaning section 7*x* removes residual toner or the like from the surface of the photosensitive drum 1*x*. By cleaning the surface of the photosensitive drum 1*x* after the primary transfer, the same photosensitive drum 1*x* can be repeatedly used to appropriately form an electrostatic latent image thereon.

Next, with reference to FIG. 1, a description is given of the image forming apparatus 100, especially of the operation related to conveyance.

The transfer paper P loaded in the cassette 16 is first conveyed by the paper feed roller 12*a* to the registration roller pair 12*b* and then conveyed by the registration roller pair 12*b* to the nip part (to the secondary transfer roller 9 and the drive roller 11) with predetermined timing. The drive roller 11 is driven by a drive motor (not shown). As the drive roller 11 is driven (rotated), the intermediate transfer belt 8 rotates counterclockwise in FIG. 1. As a result, the toner images formed on the respective photosensitive drums 1*x* in the manner described above are sequentially transferred, in the primary transfer process, to be superimposed on one another on the intermediate transfer belt 8. In addition, the transfer paper P is conveyed from the registration roller pair 12*b* to the nip part. The toner images superimposed on the intermediate transfer belt 8 (as a full-color image) are transferred, in the secondary transfer process, to the transfer paper P at the nip part by the secondary transfer roller 9. Then, the transfer paper P onto which the toner images are transferred is conveyed to the fixing section 13. According to the present embodiment, the sections for forming toner images on the transfer paper P (namely, the image forming sections Px, the intermediate transfer belt 8, the nip part, and the like) together correspond to a toner image forming section.

The fixing section 13 applies heat and pressure to the transfer paper P so as to fix the toner image to the transfer paper P. In particular, the fixing roller pair 13*a* applies heat and pressure to the transfer paper P. Consequently, the toner images are fixed to the surface of the transfer paper P, so that a full-color image is formed. The transfer paper P on which the full-color image is formed is conveyed to the branch section 14. The branch section 14 selects one of the conveyance paths (conveyance directions), which are branched off in a plurality of directions. The transfer paper P is conveyed in the conveyance direction selected by the branch section 14.

When an image is to be formed only on a single side of the transfer paper P, the transfer paper P is ejected to the ejection stacking section 17 by the ejection roller pair 15 after an image is formed on one side of the transfer paper P. Thus, the transfer paper P (recording medium) stacked in the ejection stacking section 17 has been subjected to the fixing process by the fixing section 13.

On the other hand, when an image is to be formed on both sides of the transfer paper P, the transfer paper P is first conveyed to the ejection roller pair 15 (and thus to the ejection stacking section 17) after an image is formed on one side of the transfer paper P. Then, as the trailing edge of the transfer paper P passes the branch section 14, the branch section 14 causes the ejection roller pair 15 to rotate in reverse so as to switch the conveyance direction of the transfer paper P. As a result, the trailing edge of the transfer paper P is directed toward a reverse conveyance path 18. Thereafter, the transfer paper P is conveyed through the reverse conveyance path 18 to the nip part (to the secondary transfer roller 9 and the drive roller 11) again, with the one side and the other side being reversed. Then, the secondary transfer roller 9 transfers the images formed on the intermediate transfer belt 8 to the other side of the transfer paper P on which no image has been formed yet. The transfer paper P is then conveyed to the fixing section 13, and the fixing section 13 fixes the toner images to the transfer paper P. As a result, an image is formed on both sides of the transfer paper P. After an image is formed on both sides, the transfer paper P is ejected to the ejection stacking section 17 by the ejection roller pair 15.

Figure 2:
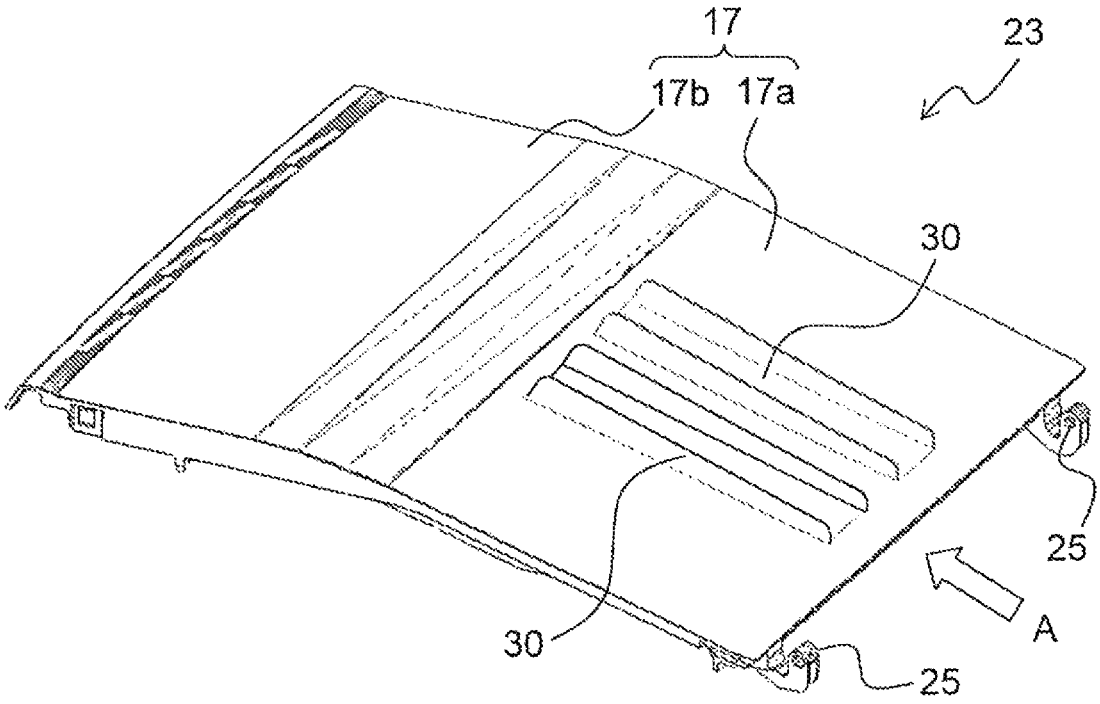
FIG. 2 is a perspective view of a top cover of the image forming apparatus according to the embodiment of the present disclosure, as seen from above (from the front surface).
Figure 3:
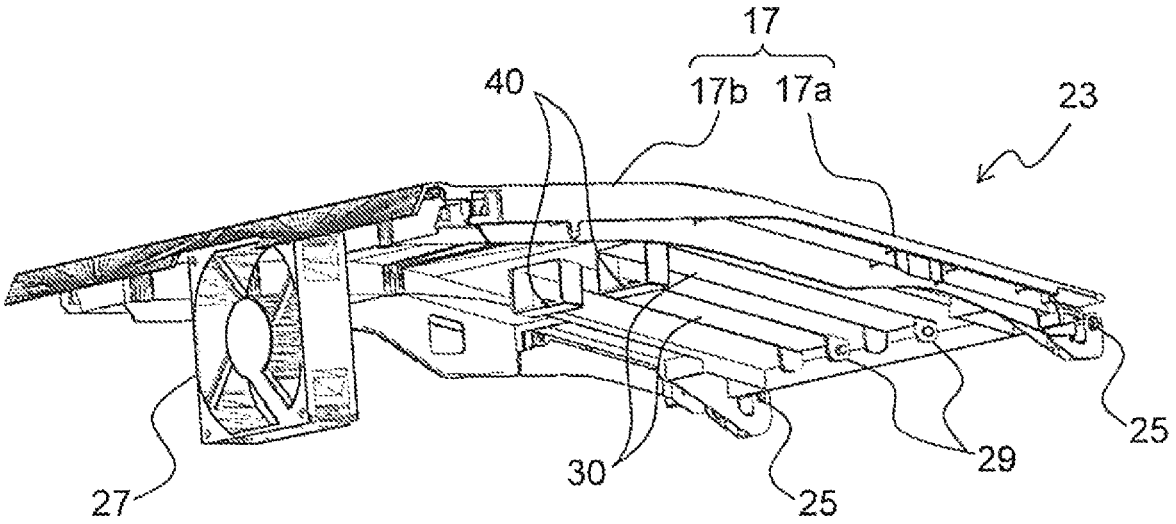
FIG. 3 is a perspective view of the top cover of the image forming apparatus according to the embodiment of the present disclosure, as seen from below (from the rear surface).
Figure 4:
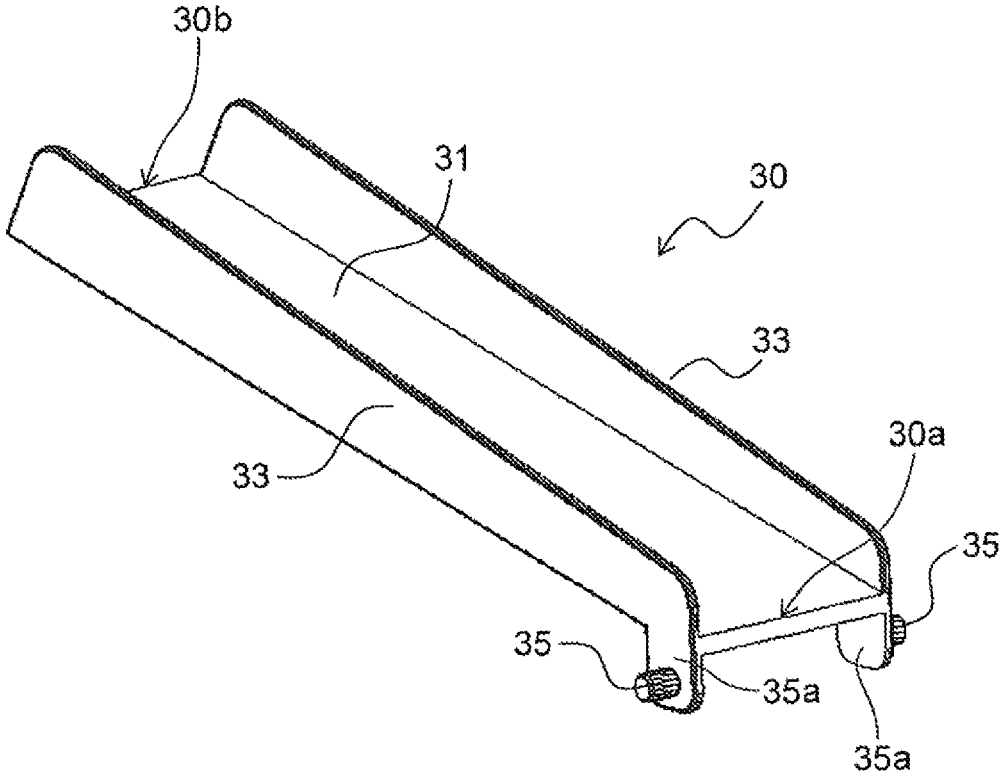
FIG. 4 is a perspective view of an external representation of a movable member included in the top cover shown in FIGS. 2 and 3.

With reference to FIGS. 1-4, the following now describes a housing (a top cover 23, in particular) of the main body of the image forming apparatus 100. FIG. 2 is a perspective view of the top cover 23 of the image forming apparatus 100, as seen from above (from the front surface). FIG. 3 is a perspective view of the top cover 23 of the image forming apparatus 100, as seen from below (from the rear surface). FIG. 4 is a perspective view of an external representation of a movable member 30 included in the top cover 23. In the following description, the direction in which each recording medium (transfer paper P) is ejected by the ejection roller pair 15 is referred to as an "ejection direction". In FIG. 2, an arrow A is directed toward the downstream side of the ejection direction of the transfer paper P.

The housing of the main body of the image forming apparatus 100 (hereinafter, referred to as an "apparatus housing") includes the top cover 23. The top cover 23 is located above the toner containers 4*x* and constitutes a top plate of the apparatus housing. The ejection stacking section 17 is formed on the top cover 23 of the main body of the image forming apparatus 100. The top cover 23 is mounted to the apparatus housing on a swing pivot 25. The top cover 23 is swingable on the swing pivot 25. The apparatus housing can be opened and closed by swinging the top cover 23. With the top cover 23 opened, replacement of the toner containers 4*x* or maintenance of the respective components (such as the developing units 3*x*) of the image forming apparatus 100 can be carried out.

The cooling fan 27 is disposed under the swinging edge (the left edge in FIG. 1) of the top cover 23. The cooling fan 27 sends air to flow between each toner container 4*x* and the ejection stacking section 17. The cooling fan 27 takes ambient air into the image forming apparatus 100 and causes the air to flow through the space between each toner container 4*x* and the top cover 23, thereby cooling the toner containers 4*x* (each corresponding to a cooling target unit) by the airflow.

As shown in FIG. 2, the ejection stacking section 17 having a bend is formed on the upper surface of the top cover 23. The ejection stacking section 17 has a first tray surface 17*a* and a second tray surface 17*b*. In addition, the ejection stacking section 17 includes an opening (hereinafter referred to as a "top opening"), the movable member 30, and a biasing member (for example, a coil spring 41 shown in FIG. 5). The top opening is formed in the first tray surface 17*a*. The movable member 30 is movable between a closed position (at which the movable member 30 closes the top opening) and an open position (at which the movable member 30 opens the top opening and which is below the closed position). The biasing member biases the movable member 30 toward the closed position.

For example, two different sizes (large size and small size) of the transfer paper P may be stacked on the ejection stacking section 17. When the large-size transfer paper P is ejected to the ejection stacking section 17, the trailing part of the transfer paper P is placed on the first tray surface 17*a*, whereas the leading part of the transfer paper P is placed on the second tray surface 17*b*. On the other hand, when the small-size transfer paper P is ejected to the ejection stacking section 17, the entire transfer paper P is placed on the first tray surface 17*a*.

The first tray surface 17*a* is inclined upward toward the downstream side in the ejection direction of the transfer paper P (toward the second tray surface 17*b*). The transfer paper P ejected to the ejection stacking section 17 slides down on the first tray surface 17*a* toward a rear wall part 21. The transfer paper P stops sliding when the trailing edge of the transfer paper P abuts against the rear wall part 21 (see FIG. 1). The sheets of transfer paper P are stacked on one another with their trailing edges abutting against the rear wall part 21 (FIG. 1).

In the image forming apparatus 100 according to the present embodiment, the ejection stacking section 17 has a plurality of the top openings extending in parallel. The top openings are adjacent to one another in a width direction of the ejection stacking section 17 that crosses the ejection direction of the recording mediums (transfer paper P). A plurality of the movable members 30 are provided in one-to-one correspondence with the plurality of top openings. More specifically, the movable members 30 are disposed one at each of two locations on the first tray surface 17*a*. Each movable member 30 is disposed in a corresponding one of the two top openings formed in the first tray surface 17*a*.

As shown in FIG. 3, each movable member 30 includes a pair of rotation pivots 29 and a spring receiver section 40 disposed on the rear surface of the top cover 23. Each pair of rotation pivots 29 is disposed at the upstream edge part of the top cover 23 in the ejection direction.

As shown in FIG. 4, each movable member 30 includes a main body having a U-shaped cross section (in X-Z cross section). The main body of each movable member 30 has: a bottom 31 that is an elongated flat plate; and a pair of guide ribs 33 each of which is formed along either edge of the bottom 31. When each movable member 30 is at the open position, the bottom 31 and the guide ribs 33 of the movable member 30 form an air duct that guides air toward the corresponding top opening.

Each guide rib 33 extends in a longitudinal direction of the bottom 31 (substantially in the Y direction). Each guide rib 33 protrudes upward from the bottom 31 (toward Z1 in FIG. 1).

According to the present embodiment, each guide rib 33 has the shape of a flat plate. However, the guide ribs 33 are not limited to such. Each guide rib 33 may have a bend, a projection and a depression, and/or a vent hole for adjusting the airflow.

The main body of each movable member 30 is provided with a supporting part at one end thereof. The supporting part has a pair of extended parts 35*a* and a pair of support shafts 35. Each extended part 35*a* extends downward from the bottom 31 (toward Z2 in FIG. 1). The extended parts 35*a* are formed integrally with the respective guide ribs 33, for example. The support shafts 35 are disposed on the respective extended parts 35*a*. Each support shaft 35 extends outward (substantially in the X direction) from the corresponding extended part 35*a*. In the following description, of the two end parts of each movable member 30 opposed in the longitudinal direction thereof (substantially in the Y direction), one end part provided with the support shafts 35 is referred to as a supporting end part 30*a*, and the other end part not provided with the support shafts 35 (that is, the end part opposed to the supporting end part 30*a*) is referred to as a rotating end part 30*b*.

Each movable member 30 has one end part (the supporting end part 30*a*) located at the upstream side in the ejection direction of the recording mediums (transfer paper P) and another end part (the rotating end part 30*b*) at the downstream side in the ejection direction of the recording mediums (transfer paper P). As the rotating end part 30*b* rotates on the supporting end part 30*a* as the pivot, the movable member 30 can open and close the top opening formed in the first tray surface 17*a*. The supporting end part 30*a* (more specifically, the pair of support shafts 35) of each movable member 30 is secured to the ejection stacking section 17 (more specifically, the corresponding pair of rotation pivots 29 of the top cover 23). Each movable member 30 is rotatably supported on the corresponding pair of rotation pivots 29 of the top cover 23. The rotating end part 30*b* of each movable member 30 moves up and down by rotating the movable member 30 (more specifically, the rotating end part 30*b*) on the supporting end part 30*a* (more specifically, the pair of support shafts 35) as the pivot.

In the state where the respective movable members 30 are mounted to the top cover 23, as shown in FIG. 5, the coil springs 41 and the spring receiver sections 40 are located at the rotating end part 30*b* of the corresponding movable member 30. In this state, the rotating end part 30*b* (more specifically, the bottom 31) of each movable member 30 abuts against the corresponding coil spring 41. Each coil spring 41 is sandwiched between the bottom 31 of the corresponding movable member 30 and the corresponding spring receiver section 40. Each coil spring 41 biases the rotating end part 30*b* of the corresponding movable member 30 upward (toward Z1).

The following describes a cooling mechanism of the image forming apparatus 100 according to the present embodiment.

In the image forming apparatus 100 according to the present embodiment, the first tray surface 17*a* of the ejection stacking section 17 is inclined upward from the upstream side toward the downstream side of the ejection direction of the transfer paper P (has an upward incline). This improves stackability of the transfer paper P. Unfortunately, in the image forming apparatus 100 according to the present embodiment, the toner container 4*d* (the toner container nearest to the ejection stacking section 17) is located extremely close to the ejection stacking section 17. Therefore, the toner container toner 4*d* is likely to be affected by heat dissipated from the transfer paper P stacked on the ejection stacking section 17.

When no or a relatively few sheets of transfer paper P are stacked on the ejection stacking section 17, the biasing force of each coil spring 41 moves the corresponding movable member 30 toward the closed position (at which the movable member 30 closes the corresponding top opening formed in the first tray surface 17*a*). As a result, as shown in FIG. 5, the upward biasing force of each coil spring 41 supports the rotating end 30*b* of the corresponding movable member 30. Consequently, the first tray surface 17*a* of the ejection stacking section 17 is flush with the bottom 31 of each movable member 30. In addition, the guide ribs 33 of each movable member 30 protrude beyond the first tray surface 17*a*. In this state, the air sent from the cooling fan 27 flows through the space present between the top cover 23 and the respective toner containers 4*a*-4*d* from the downstream side to the upstream side (toward Y2) in the ejection direction of the transfer paper P, as indicated by an arrow shown in FIG. 5. The airflow as described above selectively cools the parts around the toner containers 4*a*-4*d*.

As the number of sheets of the transfer paper P stacked on the ejection stacking section 17 increases, the coil springs 41 are compressed by the weight of the transfer paper P placed on the guide ribs 33 of the respective movable members 30, as shown in FIG. 6. As a consequence, each movable member 30 is moved toward the open position (at which the movable member 30 opens the corresponding top opening in the first tray surface 17*a*) against the biasing force of the corresponding coil spring 41. More specifically, the movable members 30 rotate counterclockwise in FIG. 6. Then, the rotating end part 30*b* of each movable member 30 moves downward (toward Z2) against the biasing force of the corresponding coil spring 41. As a consequence, in the state shown in FIG. 6, a clearance C (gap) is formed between the first tray surface 17*a* (or the transfer paper P closing the top openings formed in the first tray surface 17*a*) and the bottoms 31 of the respective movable members 30. The air sent from the cooling fan 27 flows through the clearance C and then into the space between the transfer paper P and the bottoms 31 of the respective movable members 30, as indicated by an arrow shown in FIG. 6. The air (airflow) produced by the cooling fan 27 flows through the top openings in the first tray surface 17*a* to cool the lower surface of the transfer paper P stacked on the ejection stacking section 17. In this way, the transfer paper P (more specifically, the lower surface of the transfer paper P) stacked on the ejection stacking section 17 can be cooled directly by the airflow.

When a recording medium (transfer paper P) of a smallest size from among all sizes of recording mediums available for stacking on the ejection stacking section 17 is stacked on the ejection stacking section 17, the location of each top opening in the first tray surface 17*a* is preferably coincident with or upstream (toward Y2) from the leading edge of the stacked recording medium in an ejection direction. The image forming apparatus 100 having such a structure is likely to achieve a sufficient cooling effect regardless of the size of transfer paper P stacked on the ejection stacking section 17.

The gap (clearance C) between the ejection stacking section 17 and the respective movable members 30 changes in accordance with the weight of the recording mediums (transfer paper P) stacked on the ejection stacking section 17. More specifically, the extent to which each movable member 30 rotates (and thus the moving amount of the rotating end part 30*b*) varies in accordance with the weight (the number of sheets) of the transfer paper P stacked on the ejection stacking section 17. The moving amount of each rotating end part 30*b* changes also depending on the biasing force of the corresponding coil spring 41. That is to say, the size of the gap (the opening amount of the clearance C) can be changed by changing the biasing force of the coil springs 41. By changing the opening amount, the amount of airflow received by the transfer paper P can be adjusted. More specifically, suppose that the movable members 30 can rotate under the condition where the transfer paper P stacked on the ejection stacking section 17 is on the order of one to a few sheets. In such a case, the stack of the transfer paper P may be deviated or pushed out of the ejection stacking section 17 by the airflow from the cooling fan 27. In view of such a risk, it is preferable to set the spring loading (spring constant) of the coil springs 41 to allow the movable member 30 to rotate only when the number of sheets (the weight) of the transfer paper P reaches a predetermined number which falls within a range of 10 to 100 (for example, 50 or 100). Note that once each movable member 30 rotates, the moving amount of the rotating end part 30*b* increases with an increase in the amount of transfer paper P stacked, until the moving amount of the rotating end part 30*b* reaches its maximum (until the rotating end part 30*b* moves to its lower limit position).

In the state where the rotating end part 30*b* of each movable member 30 is supported only by the biasing force of the corresponding coil spring 41, the position of the rotating end part 30*b* changes in accordance with the weight of the transfer paper P. Therefore, the stackability of the transfer paper P to be stacked on the ejection stacking section 17 may be reduced. For the purpose of allowing the transfer paper P to be stably stacked on the ejection stacking section 17, it is therefore preferable to set the biasing force (spring constant, for example) of the coil springs 41 such that the moving amount of each rotating end part 30*b* reaches the maximum (each rotating end part 30*b* moves to the lower limit position within a range of the open position) when the weight (the number of sheets) of the transfer paper P reaches a predetermined value (preferably, a predetermined number of sheets within a range of 50 to 200).

The lower limit position (lowest possible position) within the range of the open position is defined to be the position where the corresponding coil spring 41 is compressed to the maximum, for example. However, the lower limit position is not limited to such. Alternatively, a limiting section may be provided to abut against each movable member 30 before the corresponding coil spring 41 is compressed to the maximum, which stops the movable member 30 to rotate any further. In this case, the position where the movable member 30 abuts against the limiting section is determined to be the lower limit position within the range of the open position.

According to the present embodiment, when no transfer paper P is stacked on the ejection stacking section 17, the movable members 30 move to the respective closed positions (at which the movable members 30 close the respective top openings formed in the first tray surface 17*a*). When each movable member is at the closed position, the bottom 31 of each movable member 30 is flush with the first tray surface 17*a*, as shown in FIG. 5. That is, no gap is formed between the first tray surface 17*a* and the bottom 31 of each movable member 30. This prevents undesirable possibilities such that a hand (especially a finger) of a user is caught in the gap between the first tray surface 17*a* and the bottom 31 of either of the movable member 30 and that foreign matter is introduced into the image forming apparatus 100 through the gap. When the transfer paper P stacked on the ejection stacking section 17 reaches a certain amount or more, the movable members 30 move to the respective open positions (at which the movable members 30 open the respective top openings). When each movable member 30 is at the open position, the clearance C that is in communication with the interior of the image forming apparatus 100 (the interior of the apparatus housing) is formed. Yet, the top openings are closed with the transfer paper P. Therefore, entry of foreign matter from the top openings is prevented.

Note that the rotating end part 30*b* of each movable member 30 may be provided with a limiting piece (not shown) to set the upper limit position of the rotating end part 30*b* of the movable member 30 at a desired location. The limiting piece limits the rotation of the corresponding movable member 30 by, for example, abutting against the rear surface of the top cover 23.

The guide ribs 33 of each movable member 30 extend in the ejection direction of the transfer paper P. The transfer paper P is ejected along the guide ribs 33 (in the longitudinal direction of the bottom 31). The transfer paper P ejected to the ejection stacking section 17 makes contact with the top of the guide ribs 33. By the provision of the guide ribs 33, the contact area between the transfer paper P and the ejection stacking section 17 can be reduced. In addition, the guide ribs 33 have the function of improving the stackability of the transfer paper P to be stacked on the ejection stacking section 17. The following describes the above-described function of the guide ribs 33.

Suppose that the ejection stacking section 17 is not provided with the movable members 30, the ejection stacking section 17 will be planar. It means that the transfer paper P ejected by the ejection roller pair 15 to the ejection stacking section 17 will have the entire rear surface in contact with the ejection stacking section 17. In this case, the contact area between the ejection stacking section 17 and the transfer paper P is large, which makes it difficult to smoothly eject the transfer paper P. In addition, the ejected sheets of the transfer paper P tend to poorly aligned. In addition, when the leading edge of the transfer paper P is strongly curled downward, the leading edge may abut against the ejection stacking section 17 substantially perpendicularly. If the curled transfer paper P is ejected all the way to its trailing edge while its leading edge stays in abutment with the ejection stacking section 17, the transfer paper P may be turned over to have the other side up on the ejection stacking section 17.

In contrast, the image forming apparatus 100 according to the present embodiment is configured such that the transfer paper P is ejected by the ejection roller pair 15 onto the guide ribs 33. It means that the contact area between the transfer paper P and the ejection stacking section 17 (more specifically, the top of each guide rib 33) is relatively small. Therefore, the transfer paper P is ejected smoothly along the guide ribs 33. In addition, the drop between the ejection roller pair 15 and the ejection stacking section 17 is reduced by the protruding height of the guide ribs 33. This is expected to reduce the possibility that the transfer paper P curled downward will be turned over.

Preferably, the top of each guide rib 33 protrudes beyond the first tray surface 17*a* when the rotating end part 30*b* of each movable member 30 is moved to the lower limit position (lowest possible position) within the range of the open position. The image forming apparatus having such a structure ensures that the transfer paper P stacked on the first tray surface 17*a* is not easily caught in the top openings. Consequently, the stackability is expected to improve. Note, however, that the present disclosure is not limited to such a structure. For example, the top of each guide rib 33 may be flush with the first tray surface 17*a* when the rotating end part 30*b* of each movable member 30 is moved to the lower limit position (lowest possible position) within the range of the open position.

The present disclosure is not limited to the embodiment described above, and various modifications may be made without departing from the gist of the present disclosure.

According to the embodiment described above, the movable members 30 each include the guide ribs 33 formed on the bottom 31 that has the shape of a flat plate. However, the configuration of each movable member 30 is not limited to such and may be optional. For example, either or both of the movable member 30 may have a rectangular cross section (in X-Z cross section). Preferably, the movable member 30 has a part that protrudes beyond the first tray surface 17*a* in the state where no transfer paper P is stacked on the ejection stacking section 17.

According to the embodiment described above, the cooling fan 27 cools the toner containers 4*a*-4*d* disposed below (directly below, for example) the ejection stacking section 17. However, what is subjected to cooling (a cooling target unit) is not limited to the toner containers and may be optional. For example, in the structure in which the laser scanning unit 5 is disposed below (directly below, for example) the ejection stacking section 17, the cooling fan 27 may cool the laser scanning unit 5.

The transfer paper P stacked on the ejection stacking section 17 may contain sheets of three or more sizes or of only one size.

Alternatively to the coil springs 41, other biasing members (such as elastic members) may be used.

The technology described above (the movable members 30 and the like) can be applied to those other than tandem-type color multifunction peripherals (see FIG. 1). For example, the technology described above is applicable to digital or analog monochrome multifunction peripherals. In addition, the technology described above may be applied to monochrome or color printers. The technology described above (the movable members 30 and the like) is especially useful when applied to image forming apparatuses that include a cooling target unit (for example, a toner container) at an upper part of the main body of the image forming apparatus and thus the recording medium heated by the fixing section is ejected onto the ejection stacking section disposed directly above the cooling target unit.

What is claimed is:

1. An image forming apparatus comprising:

an ejection stacking section configured to stack one or more recording mediums each having an image formed thereon;

a cooling target unit disposed below the ejection stacking section; and a cooling fan configured to send air to flow between the cooling target unit and the ejection stacking section, wherein the ejection stacking section includes an opening, a movable member configured to be movable between a closed position at which the movable member closes the opening and an open position at which the movable member opens the opening, the open position being below the closed position, and a biasing member biasing the movable member toward the closed position, and in response to that the recording mediums are stacked on the ejection stacking section, the movable member moves toward the open position against a biasing force of the biasing member to allow the air sent from the cooling fan to flow through the opening so as to cool a lower surface of the recording mediums stacked on the ejection stacking section.

2. An image forming apparatus according to claim 1, wherein when a recording medium of a smallest size from among all sizes of recording mediums available for stacking on the ejection stacking section is stacked on the ejection stacking section, a location of the opening is coincident with or upstream from a leading edge of the stacked recording medium in an ejection direction.

3. An image forming apparatus according to claim 1, wherein a gap between the ejection stacking section and the movable member changes in accordance with a weight of the recording mediums stacked on the ejection stacking section.

4. An image forming apparatus according to claim 1, wherein the movable member moves to a lower limit position within a range of the open position when the number of the recording mediums stacked on the ejection stacking section is equal to a predetermined number or more.

5. An image forming apparatus according to claim 1, wherein the movable member has a bottom and a guide rib, the guide rib protruding upward from the bottom and extending in an ejection direction of the recording mediums.

6. An image forming apparatus according to claim 5, wherein the guide rib protrudes beyond the ejection stacking section when the movable member moves to a lower limit position within a range of the open position.

7. An image forming apparatus according to claim 5, wherein when the movable member is at the open position, the bottom and the guide rib of the movable member form an air duct configured to guide the air toward the opening.

8. An image forming apparatus according to claim 1, wherein the movable member has one end part located at an upstream side in an ejection direction of the recording mediums and another end part at a downstream side in the ejection direction, and as said another end part rotates on the one end part as a pivot, the movable member opens and closes the opening, and the biasing member biases said another edge part upward.

9. An image forming apparatus according to claim 1, wherein a plurality of the openings are provided in one-to-one correspondence with a plurality of the movable members, the openings being adjacent to one another in a width direction of the ejection stacking section, the width direction crossing an ejection direction of the recording mediums.

10. An image forming apparatus according to claim 1, wherein the cooling target unit is a toner reservoir configured to store toner.

11. An image forming apparatus according to claim 1, wherein a main body of the image forming apparatus includes a toner image forming section configured to form a toner image on a recording medium, and a fixing section configured to fix the toner image to the recording medium by heating the recording medium, wherein each recording medium stacked on the ejection stacking section has been subjected to the fixing by the fixing section.

12. An image forming apparatus according to claim 11, wherein the fixing section is located at an upper part of the main body.

13. An image forming apparatus according to claim 11, wherein the main body includes a top cover, and the ejection stacking section is formed on the top cover.

14. An image forming apparatus according to claim 13, wherein the cooling target unit is located at an upper part of the main body and below the top cover.

* * * * *